United States Patent [19]

Saito et al.

[11] Patent Number: 4,946,381

[45] Date of Patent: Aug. 7, 1990

[54] PULSATING COMBUSTION SYSTEM CAPABLE OF VARYING COMBUSTION POWER

[75] Inventors: Kazuo Saito, Fujisawa; Ichiro Hongo, Yokohama; Akio Mitani, Fuji; Hiroshi Ito, Yokohama, all of Japan

[73] Assignee: Kabushiki Kaisha Toshiba, Kawasaki, Japan

[21] Appl. No.: 437,187

[22] Filed: Nov. 16, 1989

[30] Foreign Application Priority Data

Nov. 30, 1988 [JP] Japan ..... 63-300926
Nov. 30, 1988 [JP] Japan ..... 63-302465

[51] Int. Cl.[5] ..... F23C 11/00
[52] U.S. Cl. ..... 431/1
[58] Field of Search ..... 431/1

[56] References Cited

U.S. PATENT DOCUMENTS 4,747,771 5/1988 Goodfellow et al. ..... 431/1
4,808,107 2/1989 Yokoyama et al. ..... 431/1
4,840,558 6/1989 Saito et al. .

OTHER PUBLICATIONS

AGA Research Bulletin 107, "The Design of Pulse Combustion Burners", J. C. Griffiths, E. J. Weber, Jun. 1969, published by American Gas Association Laboratories.

*Primary Examiner*—Carroll B. Dority
*Attorney, Agent, or Firm*—Cushman, Darby & Cushman

[57] ABSTRACT

A combustion chamber of a pulsating combustor is supplied with fuel from a fuel-supplying system and with air for combustion from an air-intake chamber through an air-intake pipe. The air-intake pipe is interiorly provided with an aerodynamic valve having a forward flow coefficient greater than a flow coefficient in a reversed direction. An air-supplying fan controlled by a combustion control unit is connected to the air-intake chamber. A fuel control valve for varying the amount of fuel supplied to the combustion chamber is connected to a fuel-supplying pipe of a fuel-supplying system. When a mixture gas within the combustion chamber is fired at the start of a pulsating combustion system, the combustion control unit rotates the air-supplying fan at high speed to forcibly feed air for combustion into the combustion chamber. When the fuel control valve is operated in order to vary the combustion power, the combustion control unit rotates the air-supplying fan in the rotational direction and at the rotational frequency corresponding to the amount of fuel varied thereby to feed air for combustion into the combustion chamber to realize an optimum ratio of fuel to air for combustion.

20 Claims, 11 Drawing Sheets

PULSATING COMBUSTION SYSTEM CAPABLE OF VARYING COMBUSTION POWER

BACKGROUND OF THE INVENTION

1. Field of the Invention

The present invention relates to a pulsating combustion system including a pulsating combustor and to a pulsating combustion system comprising a pair of pulsating combustors parallel-connected.

2. Description of the Related Art

Normally, a pulsating combustion system including a pulsating combustor comprises, in addition to a combustion chamber of the pulsating combustor for burning a mixture gas, i.e., air-fuel mixture, intermittently or pulsatively, a tail pipe for exhausting exhaust gas connected to an exhaust port of the combustion chamber, an aerodynamic valve provided in an air passage for supplying air to the combustion chamber, the aerodynamic valve having its forward flow efficiency larger than backward flow efficiency, an air-intake chamber connected upstream of the aerodynamic valve to reduce noises, a fuel supply valve for limiting a quantity of fuel flowing into the combustion chamber, an ignitor for igniting the mixture gas supplied into the combustion chamber at the time of start, an exhaust chamber connected downstream of the tail pipe, and an air-supplying fan having a small capacity connected upstream of the air-intake chamber.

In the pulsating combustion system of the type as described above, air is fed into the combustion chamber by the air-supplying fan to mix with fuel. When the mixture gas is ignited by the ignitor, it is explosively combusted. As a result, the pressure within the combustion chamber increases, and the combustion gas is exhausted at high speed through the exhaust port of the combustion chamber. As a result of this gas-exhaustion, a negative pressure is generated within the combustion chamber. When the negative pressure is generated within the combustion chamber as described above, air and fuel are self-attracted. When the air and the fuel flow into the chamber, each in a predetermined amount, and are mixed, the resultant mixture is ignited by the flame remaining in the chamber. The explosive combustion is again performed. Therefore, normally, in the pulsating combustion system, the air-supplying fan can be stopped during the normal combustion, which is one of merits.

Recently, however, it has been desired that the pulsating combustion system having a pulsating combustor as described above is incorporated into various systems such as a domestic hot-water supply system. To meet this demand, a pulsating combustion system capable of considerably varying the combustion power. However, the variable width of performance of the pulsating combustion system cannot be controlled freely in terms of the fact that air is self-attracted. Namely, when the combustion amount is increased or decreased, shortage or surplus of air results, and therefore, the combustion amount can be varied merely in the extremely narrow range.

The aerodynamic valve used in the pulsating combustion system as mentioned above cannot completely prevent a backflow. Therefore, a part of the combustion gas flows back into the air-intake chamber, and the backflow combustion gas is again taken into the combustion chamber. As a result, it becomes difficult to self-attract air necessary for combustion, often failing to obtain a stabilized pulse combustion. In addition, a temperature of the mixture gas of air and fuel flowing into the combustion chamber when the operation starts is the same as that of atmosphere, but if the mixture gas is once fired, the temperature thereof rapidly rises. The temperature of the gas within the combustion chamber before and after firing at the time of starting operation rises from temperature $T_1$ (=293K) to temperature $T_2$ (=1573K). Accordingly, let $V_1$ be the volume of the gas flowing into the combustion chamber prior to stating of operation, the volume $V_2$ under the condition of temperature $T_2$ is given by the following formula:

$$V_2/V_1=T_1/T_2$$

The ratio of volume $V_2/V_1$ before and after firing at the time of starting operation is approximately 5.7. Since a diameter of the tail pipe is constant, the flow velocity v of the combustion gas flowing into the tail pipe is proportional to the increase $\Delta V$ in volume ($v \propto \Delta V$). The pressure loss $\Delta P$ in the combustion chamber at that time is proportional to a square of the flow velocity v of the combustion gas ($\Delta P \propto v^2$). Accordingly, when the temperature of the combustion chamber before and after firing at the time of starting operation changes from 20° C. (293K) to 1300° C. (1573K), the pressure loss is about 29 times of that prior to firing.

Particularly in the case where the aerodynamic valve or tail pipe is provided, the pressure loss of the valve is great, and therefore, the pressure loss as a whole further increases. For fuel supplied to the pulsating combustor, natural gas is normally used. As an example in case of methane gas, when the concentration thereof in the mixture gas is 5% to 15%, good combustion is obtained. However, when the pressure loss increases after firing, air in the amount required for combustion cannot be obtained, and the concentration of fuel in the mixture gas becomes higher than 15%, giving rise to a problem that the mixture gas cannot be fired smoothly.

Recently, the pulsating combustion system having a pair of pulsating combustors parallel-connected has been used in order to cope with the problem of noises. In the pulsating combustion system using the pair of pulsating combustors, the gas intake, combustion-explosion, and gas exhaustion in the first pulsating combustor can be 180° out of phase with those taking place in the second pulsating combustor. However, the aforesaid pulsating combustion system also has a problem similar to that of the pulsating combustion system using one pulsating combustor as previously mentioned.

SUMMARY OF THE INVENTION

It is therefore an object of the present invention to provide a pulsating combustion system capable of varying a combustion power in a wide range while keeping a high combustion efficiency.

It is a further object of the present invention to provide a pulsating combustion system in which an aerodynamic valve is provided in an air passage which can always perform stable combustion after firing.

According to the present invention, there is provided a pulsating combustion system comprising: a pulsating combustor including a combustion chamber having an air-intake port and an exhaust port, an air-intake pipe having one end connected to an air-intake port, and a tail pipe having one end connected to the exhaust port; fuel supply means for supplying fuel into the combustion chamber; air-intake means for supplying combustion air into the combustion chamber through the air-intake pipe and the air-intake port, the air-intake means comprising an air supply source for supplying the combustion air, and back-flow limiting means provided on the air-intake pipe to limit a backflow of air from the interior of the combustion chamber to the air supply source; fuel amount varying means connected to the fuel supply means to vary the amount of fuel supplied to the combustion chamber; and pressure control means for controlling the amount of air flowing into the combustion chamber by variably controlling a differential between pressure within the combustion chamber and pressure between the air supply source and the back-flow limiting means according to the amount of fuel varied by the fuel amount varying means.

According to the present invention, there is further provided a pulsating combustion system comprising: a pair of pulsating combustors having the same structure each including a combustion chamber having an air-intake port and an exhaust port, an air-intake pipe having one end connected to the air-intake port, and a tail pipe having one end connected to the exhaust port; fuel supply means for supplying fuel into the combustion chambers; air-intake means for supplying combustion air into the combustion chambers through the air-intake pipe and the air-intake port, the air-intake means having an air supply source for supplying the combustion air, and backflow limiting means provided on the air-intake pipes to limit the backflow of air from the interior of the combustion chambers to the air supply means; fuel amount varying means connected to the fuel supply means to vary the amount of fuel supplied to the combustion chambers; and pressure control means for controlling the amount of air flowing into the combustion chambers by variably controlling a differential between pressure within the combustion chambers and pressure between the air supply source and the backflow limiting means according to the amount of fuel varied by the fuel amount varying means.

According to the present invention, there is still further provided a pulsating combustion system comprising: a pulsating combustor including a combustion chamber having an air-intake port and an exhaust port, an air-intake pipe having one end connected to the air-intake port, a tail pipe having one end connected to the exhaust port, and ignition means provided within the combustion chamber to ignite a mixture gas of air and fuel within the combustion chamber at the time of start; fuel supply means for supplying fuel into the combustion chamber; air-intake means for supplying combustion air into the combustion chamber through the air-intake pipe and the air-intake port, the air-intake means including an air supply source for supplying the combustion air connected to the air-intake pipe, and an aerodynamic valve provided within the air-intake pipe, the aerodynamic valve having a forward flow coefficient greater than a flow coefficient in a reverse direction, the aerodynamic valve limiting a backflow of air from the interior of the combustion chamber to the air supply source; and pressure control means for maintaining at a predetermined value or more a pressure differential between pressure upstream of the aerodynamic valve and pressure within the combustion chamber, at least as from the time when the mixture gas is fired by the ignition means at the time of starting operation of the pulsating combustor.

DETAILED DESCRIPTION OF THE PREFERRED EMBODIMENTS

Figure 1:
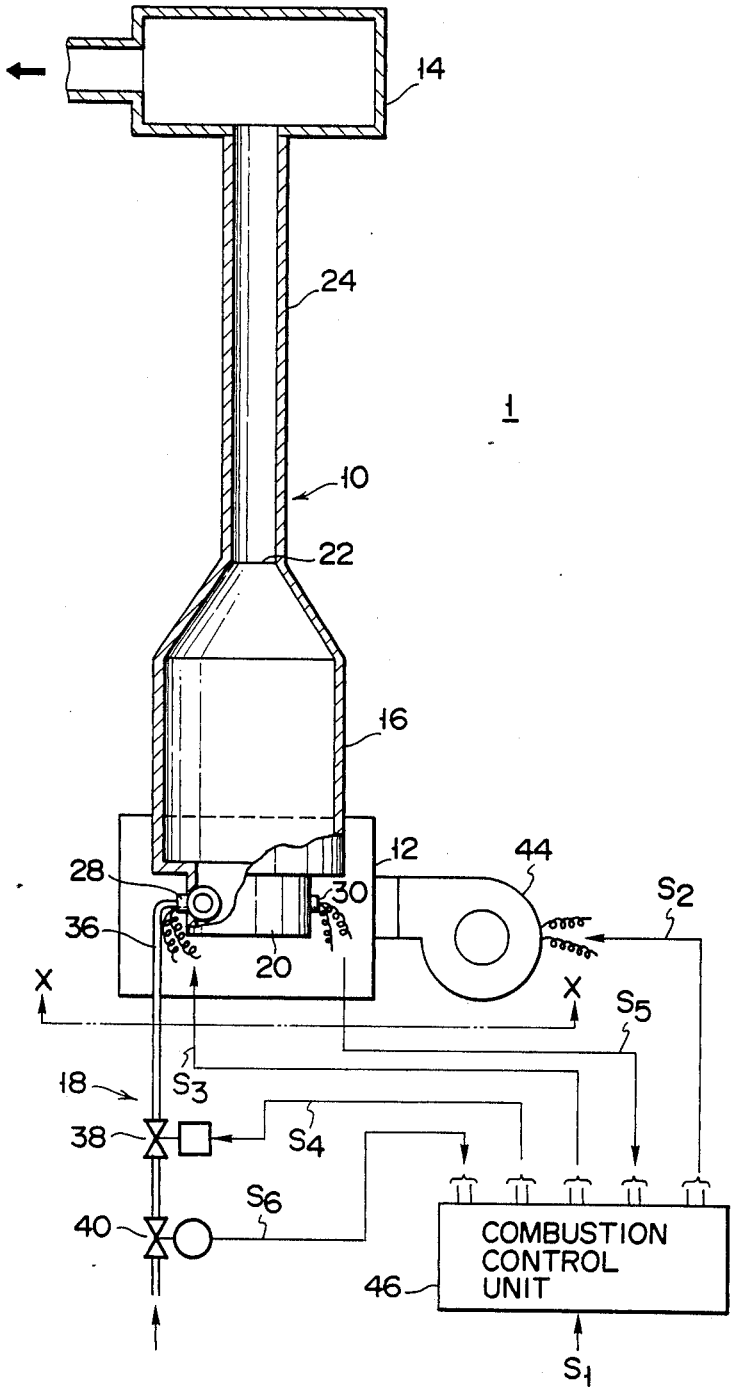
FIG. 1 is a partially sectional front view showing a pulsating combustion system using a single pulsating combustor according to a first embodiment of the present invention.
Figure 2:
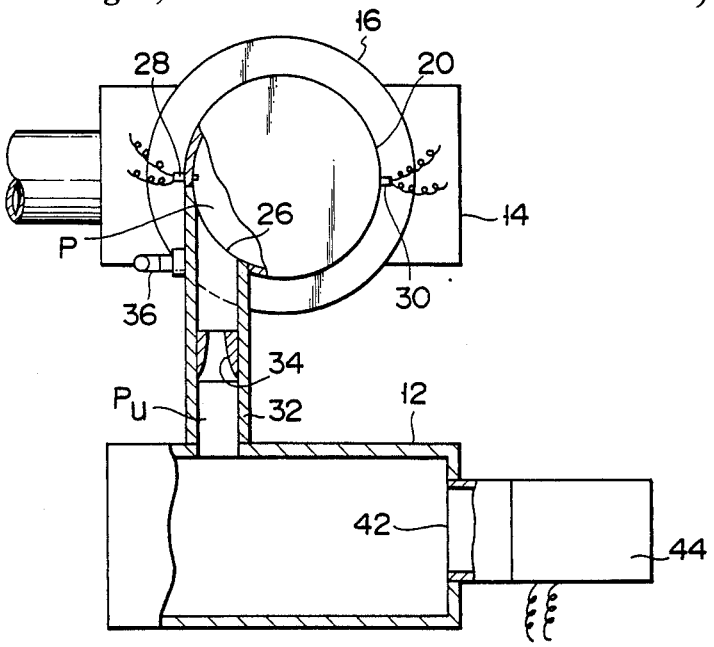
FIG. 2 is a partially sectional, side view taken along line X—X in FIG. 1.

Referring to FIGS. 1 and 2, there is disclosed a pulsating combustion system 1 using a single pulsating combustor 10. The pulsating combustion system 1 comprises a cylindrical air-intake chamber 12, an exhaust chamber 14, and a pulsating combustor 10 connected between the intake chamber 12 and the exhaust chamber 14. The pulsating combustor 10 includes a combustion 16 and a fuel-supply system 18 for supplying fuel gas to the combustion chamber 16.

The combustion chamber 16 has a cylindrical shape having a bottom of which one end is closed by a closed bottom 20 and the other end has an exhaust port 22. The exhaust port 22 is connected to the exhaust chamber 14 through a tail pipe 24.

An air-intake port 26 is formed as shown in FIG. 2 in the peripheral wall of the combustion chamber 16 and at a position in the vicinity of the closed bottom 20. An ignitor 28 with a discharge gap portion positioned within the combustion chamber 16 as shown in FIG. 2 is mounted in the peripheral wall of the combustion chamber 16 and at a position in the vicinity of the air-intake port 26. A flame sensor 30 for detecting whether or not the mixture gas within the combustion chamber 16 is combusted is mounted in the peripheral wall of the combustion chamber 16 and at the position opposed to the ignitor 28.

One end of an air-intake pipe 32 is connected to the air-intake port 26. The other end of the air-intake pipe 32 is connected to the air-intake chamber 12. The air-intake pipe 32 is connected to the combustion chamber 16, with the axis extending at right angle to the axis of the combustion chamber 16 but not intersecting therewith.

An aerodynamic valve 34 whose forward flow efficiency is greater than backward flow efficiency is inserted at a position halfway of and within the air-intake pipe 32. The aerodynamic valve 34 is in the form of a nozzle of which open area is gradually reduced from the air-intake chamber 12 toward the combustion chamber 16. That is, the aerodynamic valve 34 is formed so as to have a small flow resistance with respect to a flow from the air-intake chamber 12 toward the combustion chamber 16 and to have a large flow resistance with respect to a flow reversed thereto.

A fuel-injection port (not shown) is formed in a portion between a portion where the aerodynamic valve 34 is positioned and a position connected to the air-intake port 26. One end of a fuel-supplying pipe 36 is connected to the fuel-injection port. The fuel-supplying pipe 36 is connected to a fuel gas supply source not shown through a fuel-supplying valve 38 composed of an electromagnetic valve as shown in FIG. 1. In this case, for example, a manually controlled fuel control valve 40 is provided between the fuel-supplying valve 38 and the fuel gas supply source to control a combustion power of the pulsating combustor 10.

An air inlet port 42 is formed, as shown in FIG. 2, at an end in an axial direction of the air-intake pipe 12. An air-supplying fan 44 for feeding air into the air-intake chamber 12 is connected to the air inlet port 42.

The aforementioned ignitor 28, the fuel-supplying valve 38 and the air-supplying fan 44 are controlled by a combustion control unit 46 in the relationship described later according to the detected result of the flame sensor 30 and an opening degree of the fuel control valve 40.

Figure 3:
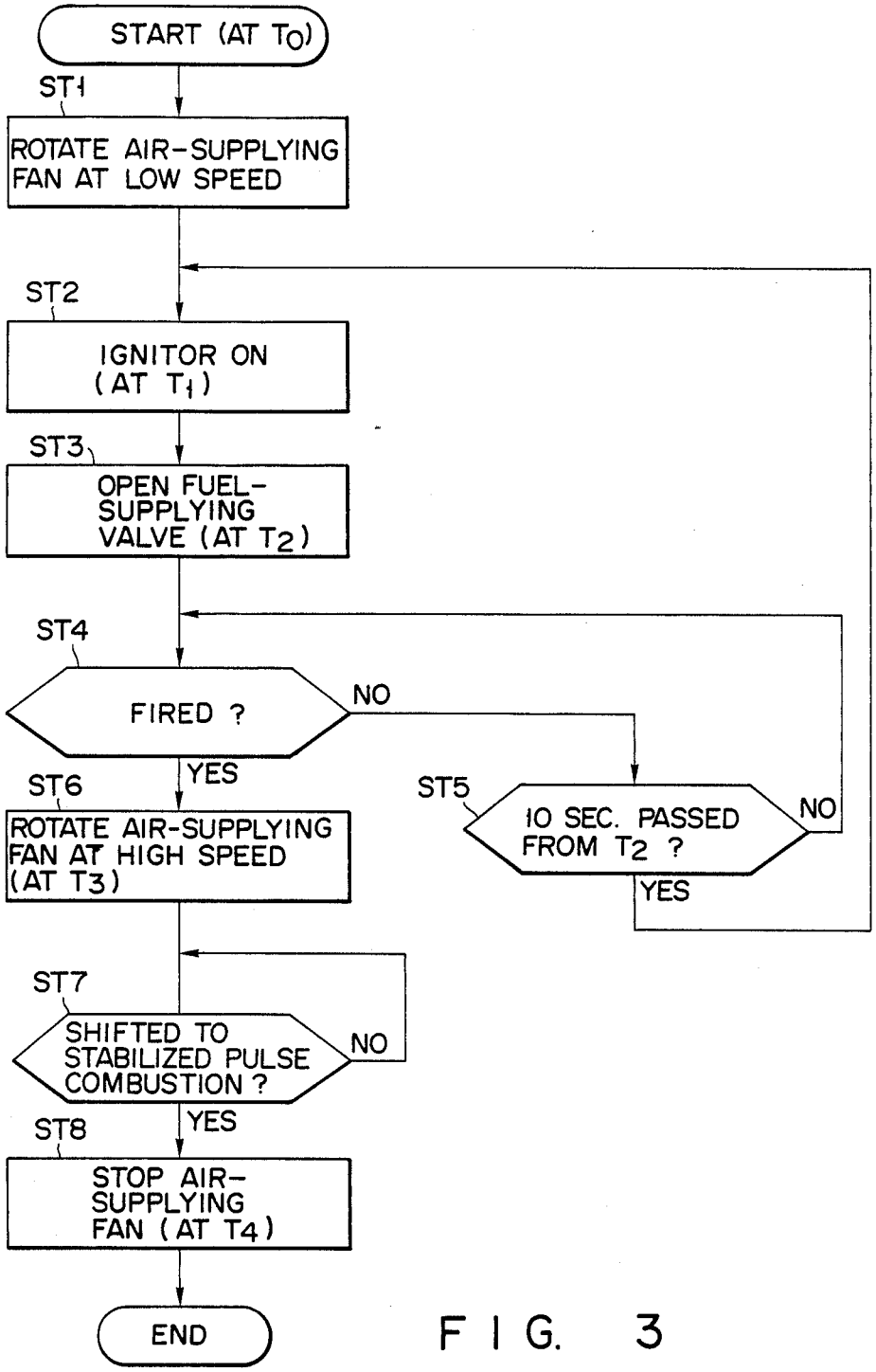
FIG. 3 is a flowchart for explaining the operation of the pulsating combustion system in FIG. 1 at the time of firing.

Next, the operation of the pulsating combustion system 1 constructed a described above at the time of firing will be described with reference to the flowchart shown in FIG. 3 and the graph of the rotational frequency of the air-supplying fan shown in FIG. 4.

Figure 4:
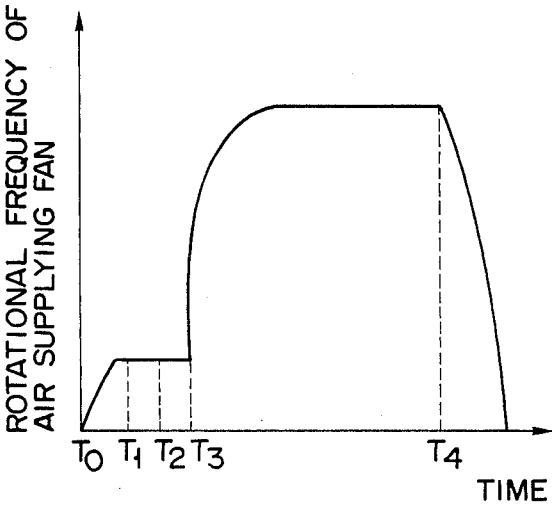
FIG. 4 is a graph showing a change in rotational frequency of an air-supplying fan at the time of firing the pulsating combustion system in FIG. 1.

First, at time $T_0$ shown in FIG. 4, when an operation start command $S_1$ is provided, a combustion control unit 46 issues a drive control command $S_2$ to the air-supplying fan 44 to rotate the fan 44 at low speed (step ST1). By the start of the air-supplying fan 44, air flows through the air-intake chamber 12, the air-intake pipe 32, the aerodynamic valve 34, the air-intake port 26 and the combustion chamber 16. This air flow causes the gas remained in the combustion chamber 16 to be purged.

At time $T_1$ after passage of a predetermined time $t_1$ from time $T_0$, the combustion control unit 46 provides an operation start command $S_3$ for the ignitor 28 to start operation of the ignitor 28 (step ST2). Next, at time $T_2$ after passage of period $t_2$ from time $T_1$, the combustion control unit 46 provides an open command $S_4$ for the fuel-supplying valve 38 to open the valve 38 (step ST3). When the fuel-supplying valve 38 is controlled to be "opened", the fuel gas is injected into the combustion chamber 16 through the fuel-supplying pipe 36 and the fuel-injection port. In this manner, the combustion chamber 16 is filled with the mixture gas of fuel gas and air. The ignitor 28 is then fired by the mixture gas because it is already in the operating state, and the pulse combustion is started in the combustion chamber 16.

At that time, the combustion control unit 46 detects whether or not the mixture gas in the combustion chamber 16 is combusted by a detection signal $S_5$ from the flame sensor 30 (step ST4). When the combustion control unit 46 detects that the mixture gas is not combusted in the combustion chamber 16, the unit 46 determines whether or not it has passed 10 seconds from the time when the fuel-supplying valve 38 is opened, namely, from time $T_2$ (step ST5). If the time has not passed 10 seconds, the execution returns to step ST4 to again detect whether or not the mixture gas in the combustion chamber 16 is combusted. That is, when detection is made that the mixture gas is not combusted in the combustion chamber 16, it continues detection whether or not the mixture gas is combusted in the combustion chamber 16 till ten seconds pass from time $T_2$. In the case where the mixture gas within the combustion chamber 16 is not combusted even after passage of 10 seconds from time $T_2$ when the fuel supplying valve 38 is opened, the execution returns to step ST2 to again provide an operation start command $S_3$ for the ignitor 28 to operate the ignitor 28 for a predetermined period of time. These steps ST2 to ST5 are repeated till the mixture gas in the combustion chamber 16 burns.

When the combustion control unit 46 detects the combustion of the mixture gas in the combustion chamber 16 by a detection signal $S_5$ from the flame sensor 30, it provides a drive control command $S_2$ for the air-supplying fan 44 at time $T_3$ to rotate the air-supplying fan 44 at high speed (step ST6). Accordingly, the air-supplying fan 44 supplies much air to the combustion chamber 16 through the air-supplying pipe 32, the aerodynamic valve 34, and air-intake port 26. Thereby, the combustion chamber 16 is supplied with more air than at the time of firing, i.e., before commencement of combustion, shifting to the stabilized pulse combustion (step ST7). At the time shifted to the stabilized pulse combustion, that is, at time $T_4$, the combustion control unit 46 provides a drive control command $S_2$ for the air-supplying fan 44 to stop the fan 44 (step ST8).

Namely, the temperature of the combustion chamber 16 is low till the mixture gas in the combustion chamber 16 is fired. Accordingly, since the pressure loss of the combustion chamber 16 is low, the air-supplying fan 44 is rotated at low speed to feed a small amount of air to the combustion chamber 16. When the mixture gas in the combustion chamber 16 is fired, the temperature of the combustion chamber 16 rapidly increases and the pressure loss of the combustion chamber 16 also increases. In this embodiment, however, a large amount of air is forcibly supplied after firing by the air-supplying fan 44, so that the stabilized combustion may continue within the combustion chamber 16.

Within the combustion chamber 16, the mixture gas intermittently explosively burns. When the mixture gas is combusted in the combustion chamber 16 as described above, pressure in the combustion chamber 16 rises, and the front pressure of the fuel-injection port also rises. Therefore, the injection of fuel into the combustion chamber 16 is automatically stopped. When the pressure in the combustion chamber 16 abruptly rises, a majority of combustion gas flows toward the exhaust chamber 14 at high speed within the tail pipe 24. The remaining combustion gas tends to flow toward the air-intake chamber 12 passing through the aerodynamic valve 34. However, since this aerodynamic valve 34 has a great flow resistance with respect to a flow from the combustion chamber 16 toward the air-intake chamber 12, the amount of combustion gas flowing toward the air-intake chamber 12 is suppressed to a small amount.

The change in pressure in the combustion chamber 16 caused by the explosive combustion of the mixture gas is propagated into the air-intake chamber 12 through the aerodynamic valve 34. This propagation increases the amount of air flowing into the combustion chamber 16 through the aerodynamic valve 34. When the combustion gas in the combustion chamber 16 flows toward the tail pipe 24 at high speed, the pressure in the combustion chamber 16 rapidly lowers to a negative pressure (less than atmospheric pressure due to the inertia of the combustion gas in the tail pipe 24.

When the pressure in the combustion chamber 16 lowers to the negative pressure, the fuel injection from the fuel injection port is restarted. With this, air flows into the combustion chamber 16 through the aerodynamic valve 34 at high speed. In this case, the air flowing into the combustion chamber 16 through the aerodynamic valve 34 impinges upon the fuel gas injected from the fuel injection port and assumes the form of flow which whirls along the inner surface of the peripheral wall of the combustion chamber 16. Therefore, the fuel and air are well mixed. In this manner, the combustion chamber 16 is again filled with the mixture gas of fuel and air. At this time, the remaining fire is present within the combustion chamber 16, and therefore, the mixture gas is fired by the remaining fire to again induce the explosive combustion.

In this way, in the present embodiment, the air required for combustion can be forcibly fed after firing, and therefore, the instability of combustion occurring when the aerodynamic valve is incorporated into the fuel-supplying pipe can be overcome.

Figure 5:
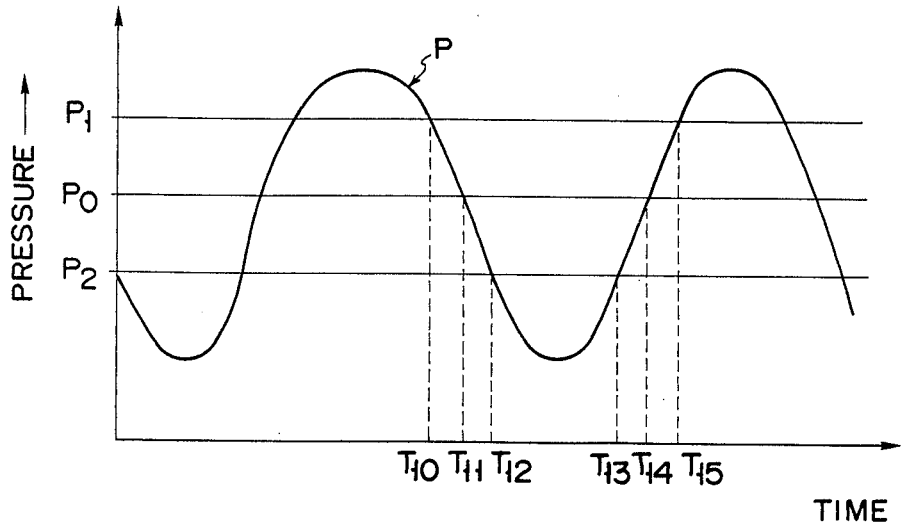
FIG. 5 is a graph for explaining the relationship between pressure of the combustion chamber and pressure upstream of the aerodynamic valve.
Figure 6:
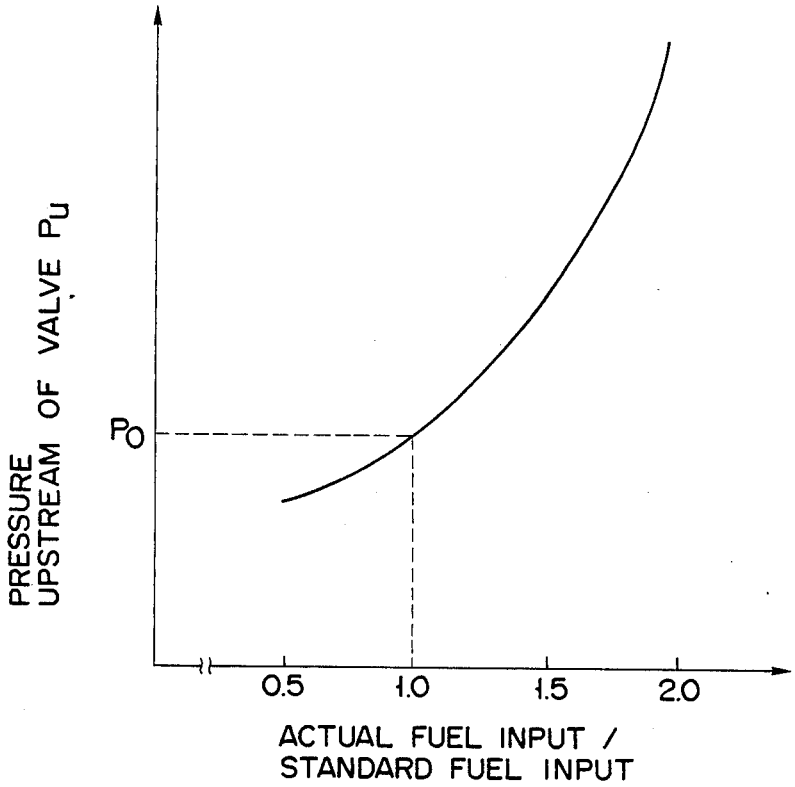
FIG. 6 is a graph showing the relationship between the ratio of actual fuel input amount to standard fuel input amount and the pressure $P_u$ upstream of the aerodynamic valve.

The varying of combustion amount in the state of stabilized pulse combustion will be described hereinafter with reference to FIGS. 5 and 6. FIG. 5 is a graph for explaining the relationship between the pressure of the combustion chamber 16 and the pressure upstream of the aerodynamic valve 34, and FIG. 6 is a graph showing the relationship between the ratio of the actual opening degree to the reference opening degree of the fuel control valve 40, namely, the ratio of the actual fuel input amount to the standard fuel input amount and the pressure $P_u$ upstream of the aerodynamic valve 34.

That is, the combustion control unit 46 detects the opening degree of the fuel control valve 40 by an opening-degree signal $S_6$ from the fuel control valve 40. The time at which the fuel control valve 40 is in the standard opening degree used as a reference, at the time of the reference time the air-supplying fan 44 is stopped, and when the opening degree increases from the reference opening degree, the air-supplying fan 44 is rotated at rotational frequency corresponding to an increased amount of the opening degree in a normal direction. At the time when the opening degree decreases from the reference opening degree, the air-supplying fan 44 is rotated at rotational frequency corresponding to the decreased amount of the opening degree in a reversed direction. Such controlling is effected by supplying a drive control command $S_2$ to the air-supplying fan 44.

That is, when the opening degree of the fuel control valve 40 is at the reference opening degree, namely, in the normal combustion, the air-supplying fan 44 remains stopped. At this time, the pressure $P_u$ upstream of the aerodynamic valve 34 is pressure $P_0$ on the axis of ordinance shown in FIG. 5. The pressure P in the combustion chamber 16 varies as shown as time passes. Accordingly, the pressure P in the combustion chamber 16 is lower than the pressure $P_0$ upstream of the aerodynamic valve 34, that is, during time $T_{11}$ to $T_{14}$ shown in the figure, the combustion air flows into the combustion chamber 16 through the aerodynamic valve 34.

When the opening degree of the fuel control valve 40 is increased in an attempt of increasing the combustion power of the pulsating combustion system 1, the opening-degree signal $S_6$ is supplied to the combustion control unit 46. The combustion control unit 46 detects the amount of fuel flowing into the combustion chamber 16 in accordance with the opening-degree signal $S_6$. The drive control command $S_2$ is provided for the air-supplying fan 44 to rotate the air-supplying fan 44 in a normal direction to control the rotational frequency to that corresponding to the opening degree, namely, that corresponding to the amount of fuel flowing into the combustion chamber 16. That is, the pressure $P_u$ upstream of the aerodynamic valve 34 is varied according to the fuel amount. That is, the combustion control unit 46 controls the rotational direction and the rotational frequency of the air-supplying fan 44 so as to assume the relationship shown in FIG. 6.

As a result, the pressure $P_u$ upstream of the aerodynamic value 34 changes from pressure $P_0$ to pressure $P_1$. Accordingly, the combustion air flows into the combustion chamber 16 through the aerodynamic valve 34 during time $T_{10}$ to $T_{15}$ at which the pressure P in the combustion chamber 16 is lower than the pressure $P_u$ ($=P_1$) upstream of the aerodynamic valve 34. That is, the combustion air in the amount corresponding to the amount of fuel flowing into the combustion chamber 16 flows into the combustion chamber 16. Accordingly, the ratio of fuel to air is substantially the same as that during the normal combustion, and combustion with high combustion amount is effected without occurrence of incomplete combustion.

When the opening degree of the fuel control valve 40 is decreased from a reference opening degree in an attempt of reducing the combustion power of the pulsating combustion system 1, the opening-degree signal $S_6$ is supplied to the combustion control unit 46. The combustion control unit 46 detects the amount of fuel flowing into the combustion chamber 16 in accordance with the opening-degree signal $S_6$. The drive control command $S_2$ is provided for the air-supplying unit 44 to rotate the air-supplying fan 44 in reversed direction to control the rotational frequency to that corresponding to the reduced amount, namely, that corresponding to the amount of fuel flowing into the combustion chamber 16. That is, the pressure $P_u$ upstream of the aerodynamic valve 34 is varied according to the fuel amount. As a result, the pressure $P_u$ upstream of the aerodynamic valve 34 changes from pressure $P_0$ to pressure $P_2$. Accordingly, the combustion air flows into the combustion chamber 16 through the aerodynamic valve 34 during the time $T_{12}$ to $T_{13}$ at which pressure P in the combustion chamber 16 is lower than pressure $P_u$ ($=P_2$) upstream of the aerodynamic valve 34. That is, the combustion air flowing into the combustion chamber 16 is less than that during normal combustion and the amount corresponding to the amount of fuel flowing into the combustion chamber 16. Accordingly, also in this case, the ratio of fuel to air is substantially the same as that during the normal combustion, and the combustion in the amount of combustion corresponding to the amount of fuel is effected without occurrence of incomplete combustion.

Figure 7:
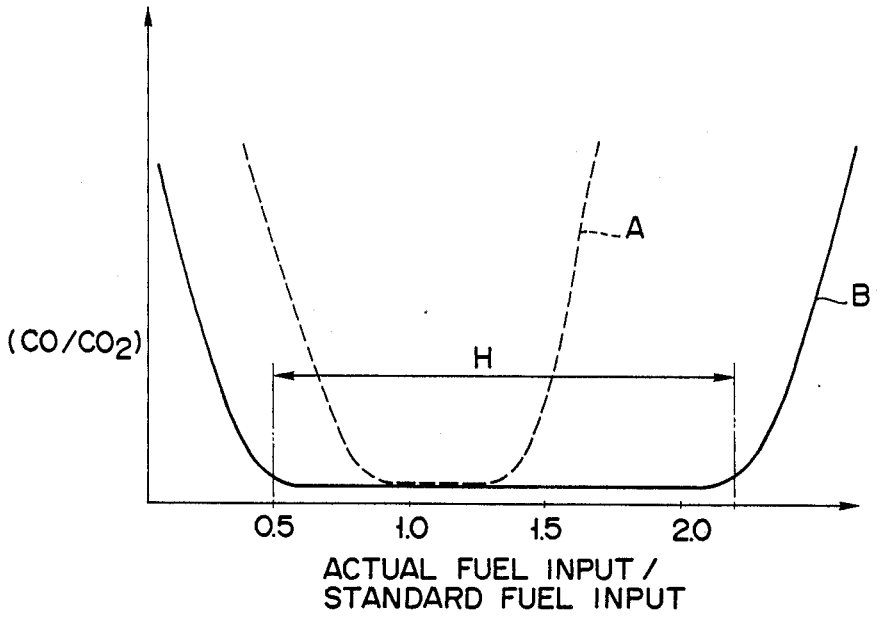
FIG. 7 is a graph showing ($CO/CO_2$) characteristics with respect to the ratio between the standard fuel input amount and the actual fuel input amount of the pulsating combustion system in FIG. 1.

FIG. 7 shows the ($CO/CO_2$) characteristics with respect to the ratio between the standard fuel input amount and the actual fuel input amount of the pulsating combustion system 1. In FIG. 7, the curve A indicated by the broken line shows the characteristics of the conventional pulsating combustion system while the curve B indicated by the solid line shows the characteristics of the pulsating combustion system 1 according to the present invention. Here, the satisfactory combustion is effected when the ($CO/CO_2$) is at a low value, and therefore, the satisfactory combustion in the pulsating combustion system 1 of the present invention is effected when the ratio between the standard fuel input amount and the actual fuel input amount is in the range of 0.5 to 2.2. That is, the pulsating combustion system 1 of the present invention has a combustion performance variable width H in the range of the ratio between the standard fuel input amount and the actual fuel input amount being approximately 0.5 to 2.2. That is, in the pulsating combustion system 1 of the present invention, the combustion performance in the constant stage of the ratio of fuel to air can be considerably varied as compared with the conventional pulsating combustion system.

In this manner, the difference between the pressure $P_u$ upstream of the aerodynamic valve 34 and the pressure P of the combustion chamber 16 is controlled according to the amount of fuel flowing into the combustion chamber 16, whereby the amount of air supply can be varied in correspondence to the increase or decrease in the fuel amount, and the variable width of combustion amount can be considerably extended in the state where the ratio between the fuel and the air for combustion is maintained substantially at constant.

Next, a pulsating combustion system having a pair of pulsating combustors parallel-connected according to a second embodiment of the present invention will be described.

Figure 8:
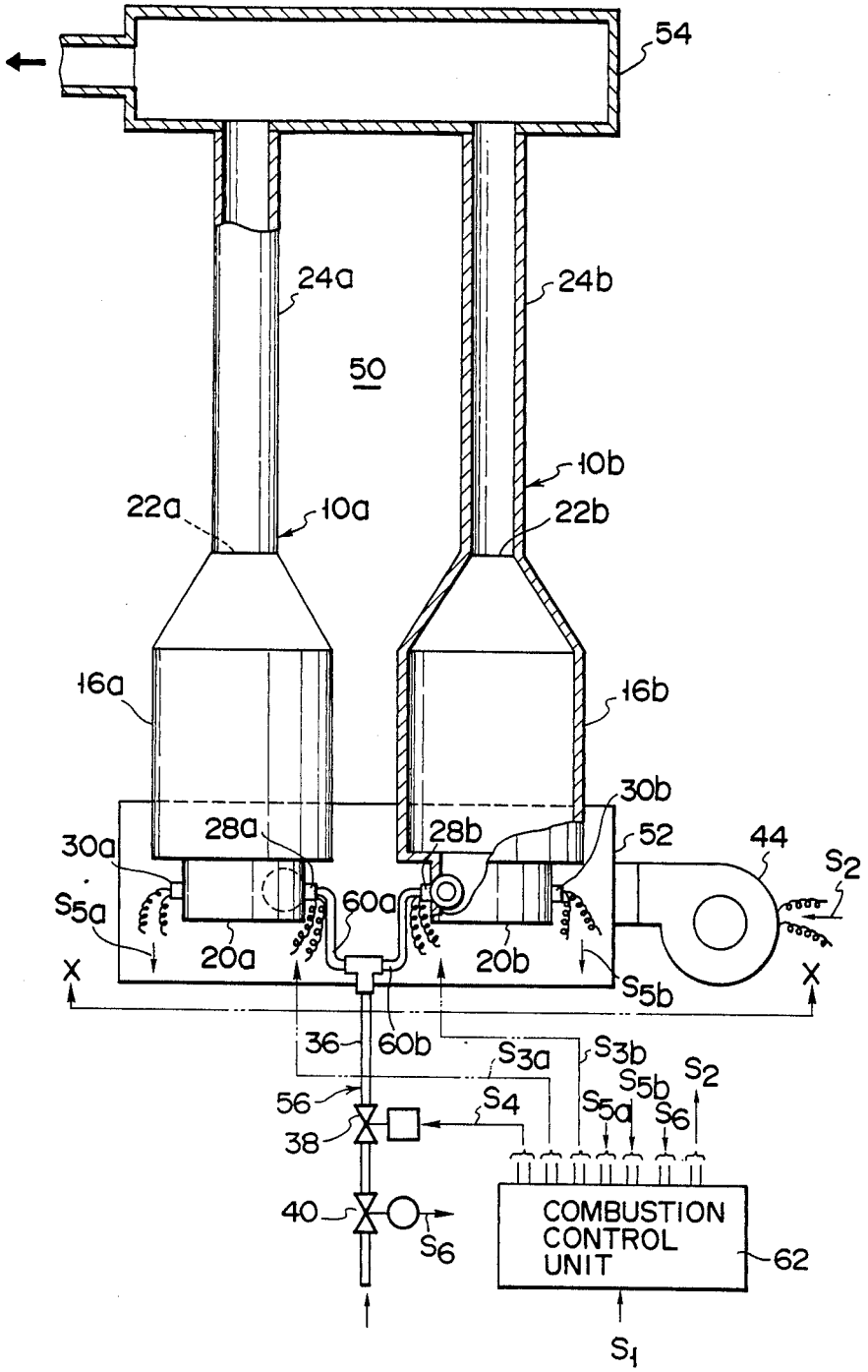
FIG. 8 is a partially sectional front view of a pulsating combustion system using a pair of pulsating combustors according to a second embodiment of the present invention.
Figure 9:
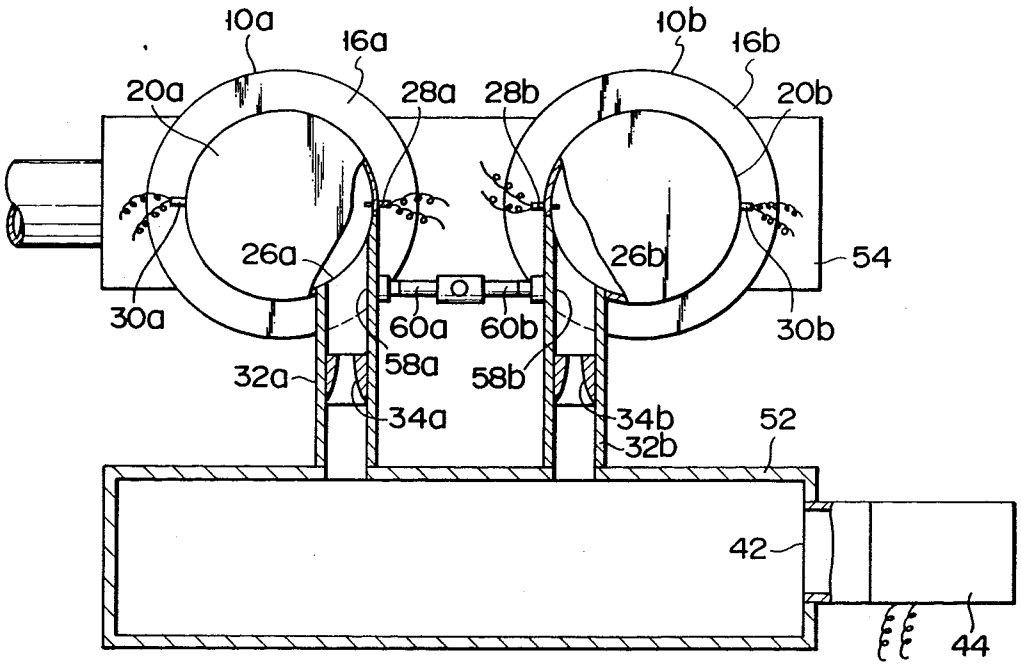
( FIG. 9 is a partially sectional side view of FIG. 8 taken along line X—X.

A pulsating combustion system 50 thus constructed is disclosed in FIGS. 8 and 9. This pulsating combustion system 50 is composed of cylindrical air-intake chamber 52, an exhaust chamber 54, pulsating combustors 10*a* and 10*b* having the same structure and the same dimension connected between the air-intake chamber 52 and the exhaust chamber 54, and a fuel-supplying system 56 for supplying fuel gas to the pulsating combustors 10*a* and 10*b*.

One pulsating combustor 10*a* has a cylindrical combustion chamber 16*a* with a bottom having one end closed by a closed bottom 20*a* and the other end formed with an exhaust port 22*a*. The exhaust port 22*a* is connected to an exhaust chamber 54 through a tail pipe 24*a*.

An air-intake port 26*a* is formed, as shown in FIG. 9, in the peripheral wall of a combustion chamber 16*a* and at a position in the vicinity of the closed bottom 20*a*. An ignitor 28*a* having a discharge gap portion positioned within the combustion chamber 16*a* is mounted, as shown in FIG. 9, in the peripheral wall of the combustion chamber 16*a* and at a position in the vicinity of an air-intake port 26*a*. A flame sensor 30*a* for detecting the state whether or not the mixture gas within the combustion chamber 16*a* is combusted is mounted in the peripheral wall of the combustion chamber 16*a* and at a position opposed to the ignitor 28*a*.

One end of an air-intake pipe 32*a* is connected to the air-intake port 26*a*. The other end of the air-intake pipe 32*a* is connected to the air-intake chamber 52. The air-intake pipe 32*a* is connected to the combustion chamber 16*a*, with the axis extending at right angle to the axis of the combustion chamber 16*a* but not intersecting therewith.

An aerodynamic valve 34*a* of which forward flow efficiency is greater than backward flow efficiency is inserted and provided at a position halfway of and within the air-intake pipe 32*a*. The aerodynamic valve 34*a* is in the form of a nozzle of which opening area is gradually reduced from the air-intake chamber 52 toward the combustion chamber 16*a*. That is, the aerodynamic valve 34*a* is formed so as to have a small flow resistance with respect to a flow from the air-intake chamber 52 toward the combustion chamber 16*a* and to have a great flow resistance with respect to a flow reversed thereto.

The other pulsating combustor 10*b* also has a combustion chamber 16*b*, a closed bottom 20*b*, an exhaust port 22*b*, a tail pipe 24*b*, an air-intake port 26*b*, an ignitor 28*b*, a flame sensor 30*b*, an air-intake pipe 32*b* and an aerodynamic valve 34*b*, and is formed to have the same structure and dimension as those of the pulsating combustor 10*a*.

Fuel-injection ports 58*a* and 58*b* are formed in respective portions between portions at which aerodynamic valves 34*a* and 34*b* are positioned and positions connected to the intake ports 26*a* and 26*b* in the peripheral wall of the air-intake pipes 32*a* and 32*b*. One pipe 60*a* at one end of the fuel-supplying pipe 36 branched into two parts is connected to one fuel-injection port 58*a*. The other pipe 60*b* at one end of the fuel supplying pipe 36 is connected to the other fuel-injection port 58*a*. The fuel-supplying pipe 36 is connected to a fuel gas supply source not shown through a fuel-supplying valve 38 in the form of an electromagnetic valve as shown in FIG. 8. In this case, for example, a manually controlled fuel control valve 40 is provided between the fuel supplying valve 38 and the fuel gas supply source in order to control the combustion power of the pulsating combustion system 50.

An air inlet port 42 is formed, as shown in FIG. 9, at one end in an axial direction of the air-intake chamber 52. An air-supply fan 44 for feeding air into the air-intake chamber 52 is connected to the air inlet port 42.

The aforementioned ignitors 28*a* and 28*b*, fuel-supplying valve 38 and air-supplying fan 44 are controlled in the relationship similar to that of the aforementioned pulsating combustor 10 by the combustion control unit 62 according to the detected results of the flame sensors 30*a* and 30*b* and the opening degree of the fuel control valve 40. The combustion control unit 62 controls the rotational frequency of the air-supplying fan 44 by supplying the drive control command $S_2$ to the air-supplying fan 44 in response to the operation start command $S_1$ and the detection signals $S_{5a}$ and $S_{5b}$ from the flame sensors 30*a* and 30*b*, as previously mentioned. The combustion control unit 64 further controls the rotational frequency of the air-supplying fan 44 by supplying the drive control command $S_2$ to the air-supplying fan 44 in response to the opening-degree signal $S_6$ from the fuel control valve 40. The combustion control unit 64 further supplies the operation start commands $S_{3a}$ and $S_{3b}$ to the ignitors 28*a* and 28*b* in response to the operation start command $S_1$ to start the ignitors 28a and 28b, and supplies the open command $S_4$ to the fuel-supplying valve 38 to open the valve 38.

Accordingly, also in the pulsating combustion system 50, air necessary for combustion can be forcibly fed into the combustion chambers 16a and 16b even after firing to thereby overcome instability of combustion occurred when the aerodynamic valves 34a and 34b are incorporated into the fuel-supplying pipes 32a and 32b. Furthermore, a differential between pressure $P_u$ upstream of the aerodynamic valves 34a and 34b and pressure P of the combustion chambers 16a and 16b can be controlled according to the amount of fuel flowing into the combustion chambers 34a and 34b to thereby vary the amount of air supply corresponding to the increase or decrease in amount of fuel. The variable width of combustion amount can be considerably extended in the state where the ratio between fuel and air for combustion is maintained substantially at constant.

Figure 10:
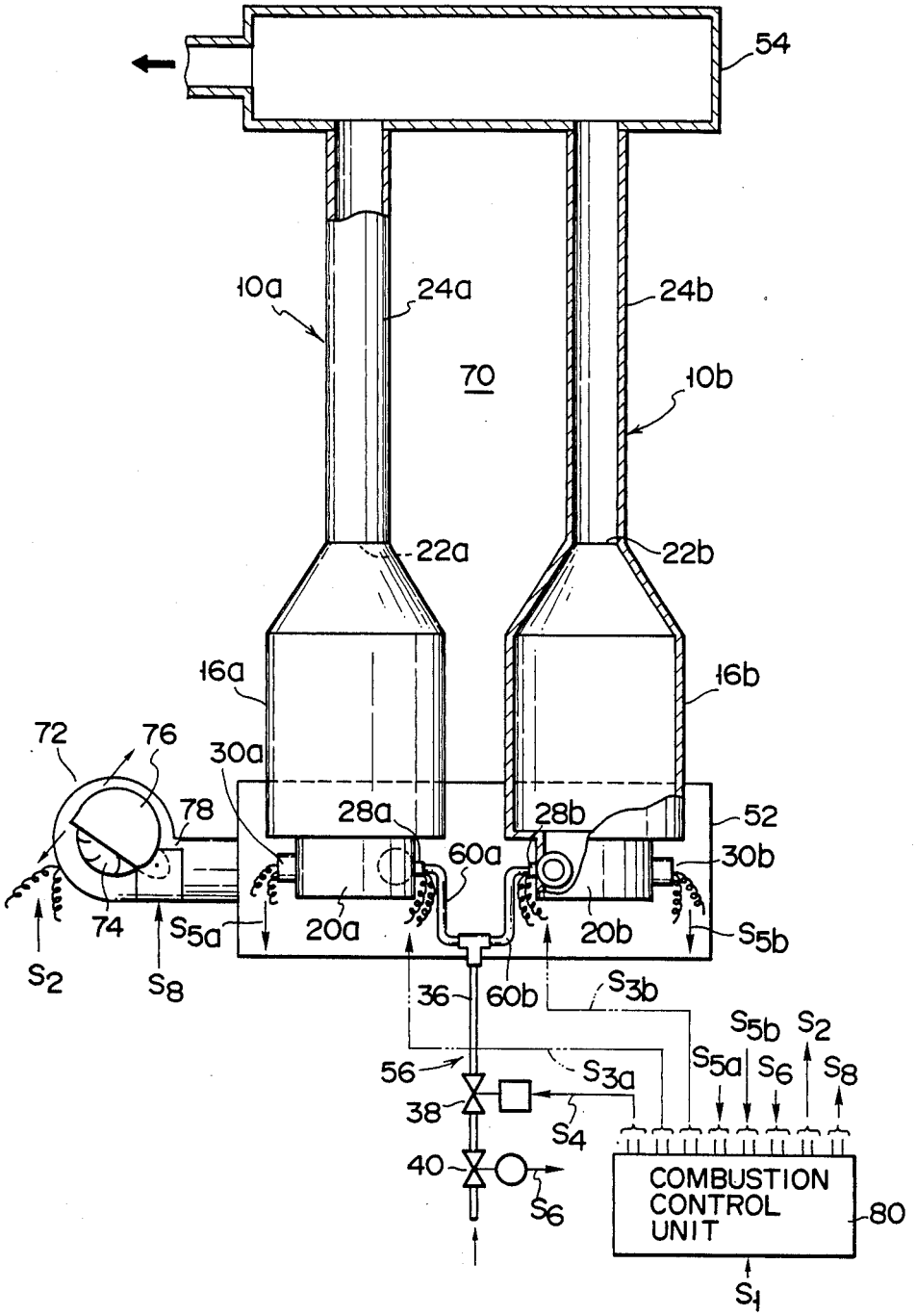
FIG. 10 is a partially sectional front view of a pulsating combustion system using a pair of pulsating combustors according to a third embodiment of the present invention.

FIG. 10 is a partially sectional front view of a pulsating combustion system 70 according to third embodiment of the present invention. In FIG. 10, the detailed description will be omitted by applying the same symbols to parts identical with those shown in FIG. 8.

The pulsating combustion system 70 is different from the pulsating combustion system 50 according to the second embodiment shown in FIG. 8 in the structure of pressure control means for controlling a differential between pressure P of the combustion chambers 16a and 16b and pressure $P_u$ upstream of the aerodynamic valves 34a and 34b. That is, in the pulsating combustion system 50 according to the second embodiment, the rotational direction and the rotational frequency of the air-supplying fan 44 have been controlled to thereby control the aforesaid differential. On the other hand, in the pulsating combustion system 70 according to this embodiment, the rotational frequency of the air-supplying fan 72 is made constant and instead, the amount of air taken into an intake port 74 of the air-supplying fan 72 is controlled.

Namely, a damper 76 is provided at the intake port 74 of the air-supplying fan 72. This damper 76 is mounted slidably on the air-supplying fan 72 by means of an actuator 78. The actuator 78 is controlled by an opening-rate control signal $S_8$ from a combustion control unit 80 to slidably move the damper 76 to vary the opening rate of the intake port 74. The combustion control unit 80 operates substantially similarly to the aforementioned combustion control unit 62 other than the control of the actuator 78.

Figure 11:
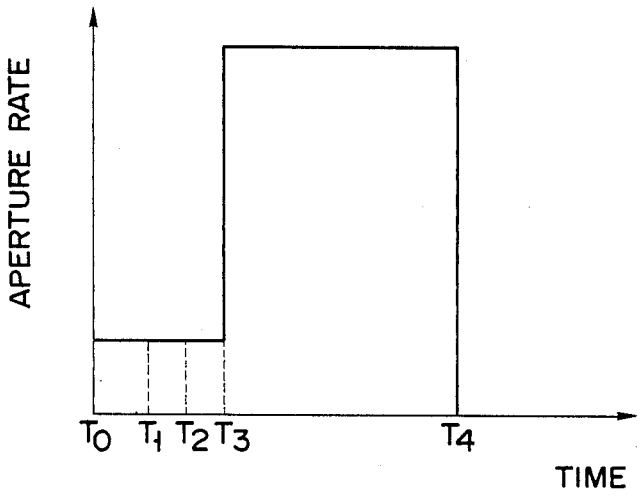
FIG. 11 is a graph showing a change in opening rate of an air-supplying fan at the time of firing the pulsating combustion system in FIG. 10.

In the pulsating combustion system 70, the opening rate is controlled as shown in FIG. 11 at the time of firing. FIG. 11 shows the time axis corresponding to that of FIG. 4. That is, the opening rate of the air intake port 74 of the air-supplying fan 72 is reduced during the time to the firing, namely, during the time to time $T_3$, and the opening rate of the air intake port 74 of the air-supplying fan 72 is enlarged by the damper 76 from the fired time $T_3$. Accordingly, air necessary for combustion can be forcibly fed into the combustion chambers 16a and 16b after firing, in a manner similar to that of the aforementioned second embodiment, and the stabilized combustion can be effected.

In case of varying the combustion amount, the opening rate of the air intake port 74 of the air-supplying fan 72 is increased or decreased by the damper 76 to thereby provide a wide variable width similarly to the aforementioned second embodiment.

Of course, the pressure control means by way of controlling the opening rate of the air intake port 74 of the air-supplying fan 72 can be also applied to the pulsating combustion system 1 as shown in FIG. 1 using a single pulsating combustor.

Figure 12:
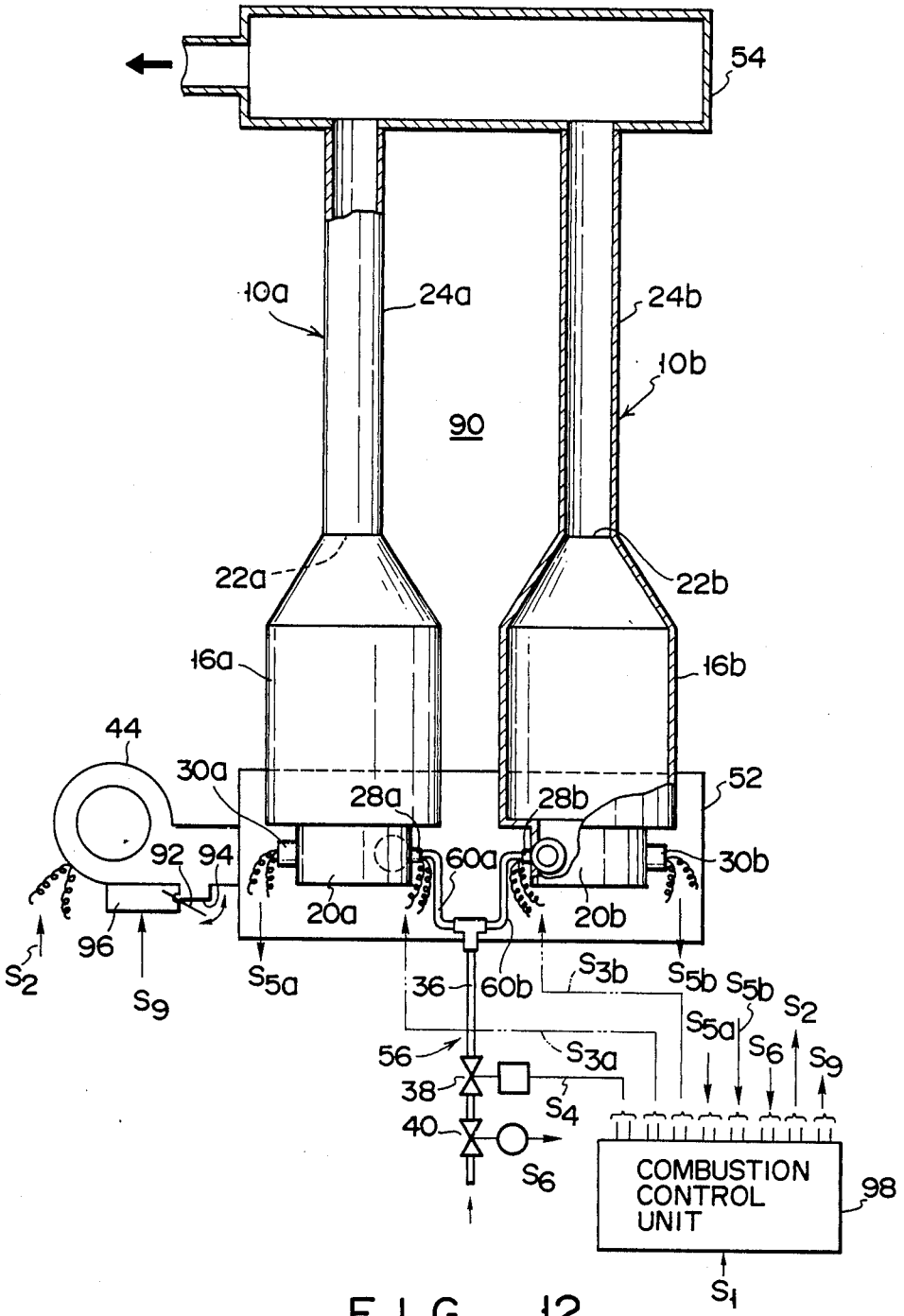
FIG. 12 is a partially sectional front view of a pulsating combustion system using a pair of pulsating combustors according to a fourth embodiment of the present invention.

FIG. 12 is a partially sectional front view of a pulsating combustion system 90 according to a fourth embodiment of the present invention. In FIG. 12, the detailed description will be omitted by applying the same symbols to parts identical with those shown in FIG. 10.

That is, the pulsating combustion system 90 is different from the pulsating combustion system 70 according to the third embodiment shown in FIG. 10 in the structure of the pressure control means for controlling a differential between pressure P of the combustion chambers 16a and 16b and pressure $P_u$ upstream of the aerodynamic valves 34a and 34b. In the pulsating combustion system 70 according to the third embodiment, the damper 76 is provided to vary the opening rate of the air intake port 74 of the air-supplying fan 72, whereas in this embodiment, a damper 92 in place of the damper 76 is provided to cover an escape hole 94 bored between the air-supplying fan 44 and the air-intake chamber 52 to escape an air stream fed by the air-supplying fan 44 outside the air-intake chamber 52. This damper 92 is supported and moved by a damper drive device 96. This damper drive device 96 is controlled by a damper drive control signal $S_9$ from a combustion control unit 98 to move the damper 92 to open and close the escape hole 94.

In the pulsating combustion system 90, when in firing or when combustion amount is varied, the damper 92 is moved to control the amount of air into the air-intake chamber 52 in a manner similar to that shown in the third embodiment. Accordingly, air necessary for combustion can be forcibly fed into the combustion chambers 16a and 16b after firing in a manner similar to that shown in the third embodiment. The stabilized combustion can be effected, and the wide variable width of combustion amount can be provided.

Of course, the pressure control means by way of controlling opening and closing of the escape hole 94 as described above can be also applied to the pulsating combustion system 1 as shown in FIG. 1 using a single pulsating combustor.

Figure 13A:
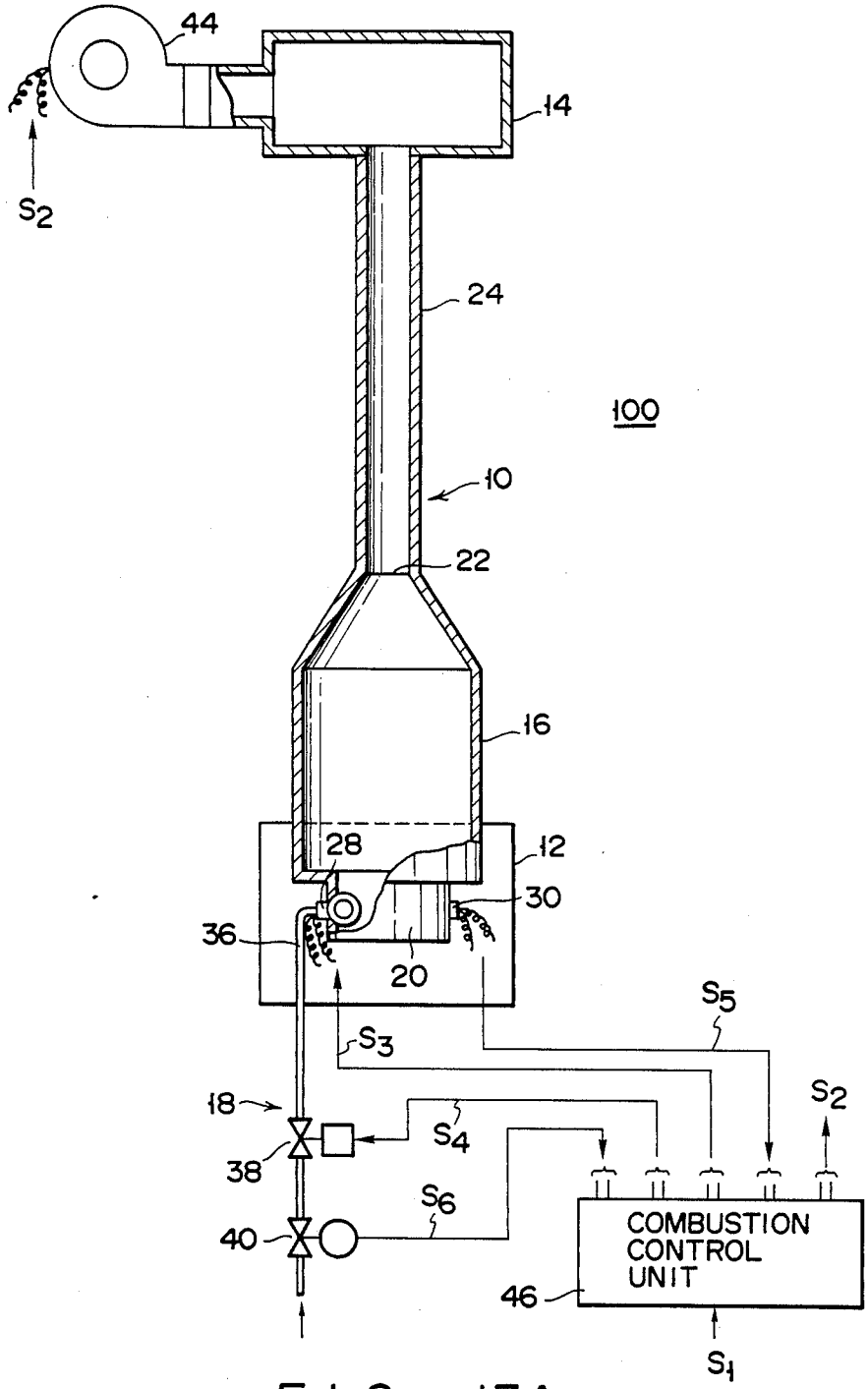
FIGS. 13A and 13B are respectively partially sectional front views of pulsating combustion systems using a single and a pair of pulsating combustors according to a fifth embodiment of the present invention.
Figure 13B:
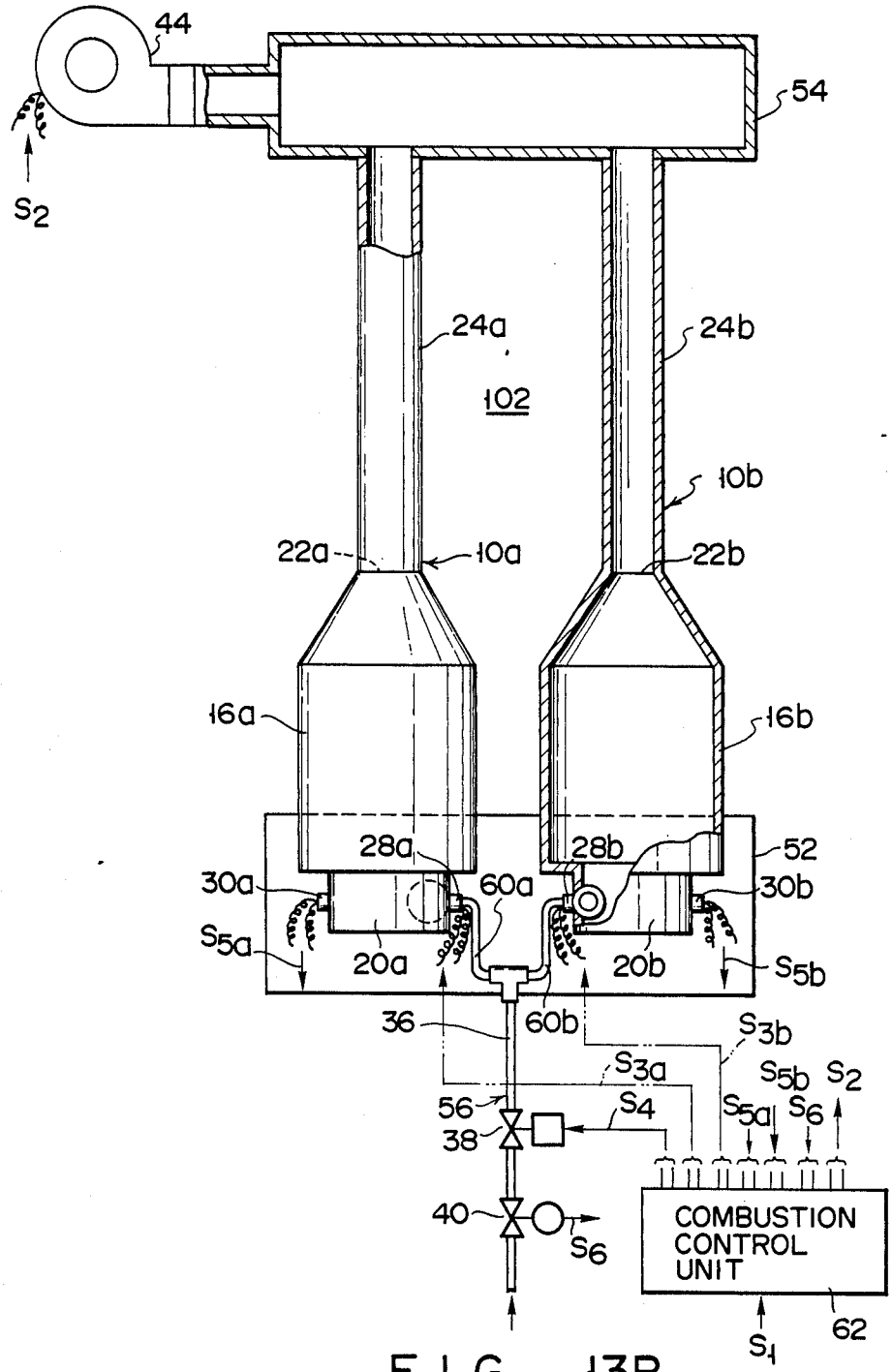

The effects similar to those of the aforementioned first and second embodiments can be obtained by connecting the air-supplying fan 44 as an air-sucking fan at downstream of the exhaust chambers 14 and 54 as shown in FIGS. 13A and 13B to variably control the suction amount of the exhaust gas instead of connecting the fan 44 at upstream of the air-intake chambers 12 and 52. Of course, such a connection as described can be also applied to the aforementioned third and fourth embodiments.

The present invention can be variously modified other than those described in the previously described embodiments. For example, an air-supplying fan may be provided within an air-intake chamber. In addition, a damper may be provided at any position as long as an air stream fed by the air-supplying fan can be restricted.

What is claimed is:

1. A pulsating combustion system comprising:

a pulsating combustor including a combustion chamber having an air-intake port and an exhaust port, an air-intake pipe having one end connected to an air-intake port, and a tail pipe having one end connected to said exhaust port;

fuel supply means for supplying fuel into said combustion chamber;

air-intake means for supplying combustion air into said combustion chamber through said air-intake pipe and said air-intake port, said air-intake means comprising an air supply source for supplying said combustion air, and back-flow limiting means provided on said air-intake pipe to limit a backflow of air from the interior of said combustion chamber to said air supply source;

fuel amount varying means connected to said fuel supply means to vary the amount of fuel supplied to said combustion chamber; and pressure control means for controlling the amount of air flowing into said combustion chamber by variably controlling a differential between pressure within said combustion chamber and pressure between said air supply source and said backflow limiting means according to the amount of fuel varied by said fuel amount varying means.

2. The system according to claim 1, wherein said pressure control means includes intake system pressure control means for controlling said pressure difference by controlling pressure between said air supply source and said backflow limiting means according to the amount of fuel varied by said fuel amount varying means.

3. The system according to claim 2, wherein said intake system pressure control means includes air amount control means for supplying air in the amount according to the amount of fuel varied by said fuel amount varying means from said air supply source.

4. The system according to claim 3, wherein said air amount control means includes an air-supplying fan connected to said air supply source to feed air into said air supply source, and control means for controlling the amount of air supplied from said air-supplying fan to said air supply source according to the amount of fuel varied by said fuel amount varying means.

5. The system according to claim 1, wherein said pressure control means includes combustion chamber pressure control means for controlling said pressure difference by controlling pressure in said combustion chamber according to the amount of fuel varied by said fuel amount varying means.

6. The system according to claim 5, wherein said combustion chamber pressure control means includes flow control means for controlling a flow rate of exhaust gas exhausted from said tail pipe according to the amount of fuel varied by said fuel amount varying means.

7. The system according to claim 6, wherein said flow control means includes an air-sucking fan connected to said tail pipe to suck exhaust gas from said tail pipe, and control means for controlling said air-sucking fan according to the amount of fuel varied by said fuel amount varying means to control the amount of suction of the exhaust gas from said tail pipe.

8. A pulsating combustion system comprising:

a pair of pulsating combustors having the same structure each including a combustion chamber having an air-intake port and an exhaust port, an air-intake pipe having one end connected to said air-intake port, and a tail pipe having one end connected to said exhaust port;

fuel supply means for supplying fuel into said combustion chambers;

air-intake means for supplying combustion air into said combustion chambers through said air-intake pipe and said air-intake port, said air-intake means having an air supply source for supplying said combustion air, and backflow limiting means provided on said air-intake pipes to limit the backflow of air from the interior of said combustion chambers to said air supply means;

fuel amount varying means connected to said fuel supply means to vary the amount of fuel supplied to said combustion chambers; and pressure control means for controlling the amount of air flowing into said combustion chambers by variably controlling a differential between pressure within said combustion chambers and pressure between said air supply source and said backflow limiting means according to the amount of fuel varied by said fuel amount varying means.

9. The system according to claim 8, wherein said pressure control means includes intake system pressure control means for controlling pressure between said air supply means and said backflow limiting means according to the amount of fuel varied by said fuel amount varying means to thereby control said differential.

10. The system according to claim 9, wherein said intake system pressure control means includes air amount control means for supplying air in the amount corresponding to the amount of fuel varied by said fuel amount varying means from said air supply source.

11. The system according to claim 10, wherein said air amount control means includes air-supplying fan connected to said air supply source to feed air into said air supply source, and control means for controlling the amount of air supplied to said air supply source from said air-supplying fan according to the amount of fuel varied by said fuel amount varying means.

12. The system according to claim 8, wherein said pressure control means includes combustion chamber pressure control means for controlling pressure within said combustion chambers according to the amount for fuel varied by said fuel amount varying means to thereby control said differential.

13. The system according to claim 12, wherein said combustion chamber pressure control means includes flow control means for controlling a flow rate of exhaust gas exhausted from said tail pipes according to the amount of fuel varied by said fuel amount varying means.

14. The system according to claim 13, wherein said flow control means includes an air-sucking fan connected to said tail pipes to suck exhaust gas from said tail pipes, and control means for controlling said air-sucking fan according to the amount of fuel varied by said fuel amount varying means to control the amount of of the exhaust gas from said tail pipes.

15. A pulsating combustion system comprising:

a pulsating combustor including a combustion chamber having an air-intake port and an exhaust port, an air-intake pipe having one end connected to said air-intake port, a tail pipe having one end connected to said exhaust port, and ignition means provided within said combustion chamber to ignite a mixture gas of air and fuel within said combustion chamber at the time of start;

fuel supply means for supplying fuel into said combustion chamber;

air-intake means for supplying combustion air into said combustion chamber through said air-intake pipe and said air-intake port, said air-intake means including an air supply source for supplying said combustion air connected to said air-intake pipe, and an aerodynamic valve provided within said air-intake pipe, said aerodynamic valve having a forward flow coefficient greater than a flow coefficient in a reverse direction, said aerodynamic valve limiting a backflow of air from the interior of said combustion chamber to said air supply source; and pressure control means for maintaining at a predetermined value or more a pressure differential between pressure upstream of said aerodynamic valve and pressure within said combustion chamber, at least as from the time when said mixture gas is fired by said ignition means at the time of starting operation of said pulsating combustor.

16. The system according to claim 15, wherein said pressure control means includes pressurizing means controlling pressure upstream of said aerodynamic valve to a predetermined pressure or more from said firing time.

17. The system according to claim 16, wherein said pressurizing means includes air-supplying fan connected to said air supply source to feed air into said air supply source at the time of starting operation, and pressurization control means for controlling the amount of air supplied from said air-supplying fan to said air supply source from said firing time to thereby increase pressure upstream of said aerodynamic valve to the predetermined pressure or more.

18. The system according to claim 15, wherein said pressure control means includes pressure reduction means for controlling a flow rate of exhaust gas exhausted from said tail pipe from said firing time to lower pressure within said combustion chamber to a predetermined pressure or less.

19. The system according to claim 18, wherein said pressure reduction means includes air-sucking fan connected to said tail pipe to suck exhaust gas from said tail pipe at the time of starting operation, and pressure reduction means for controlling the amount of suction by said air-sucking fan to thereby lower pressure within said combustion chamber to the predetermined pressure or less.

20. The system according to claim 15, which further comprises a second pulsating combustor formed to be paired with said pulsating combustor so as to have the same structure and same dimension as those of said pulsating combustor, and wherein said fuel supply means includes means for supplying fuel into said combustion chambers, said air supply source is connected to the air-intake pipes of said pulsating combustors, said air-intake pipes are respectively provided with aerodynamic valves each having a forward flow coefficient greater than a flow coefficient in a reversed direction and limiting a backflow of air from the interior of corresponding combustion chambers to said air supply source, and said pressure control means includes means for maintaining at a predetermined value or more a differential between pressure upstream of said aerodynamic valves and pressure within said combustion chambers from the time when said mixture gas is fired by said ignition means.

* * * * *